United States Patent [19]

Renda et al.

[11] Patent Number: 4,596,261

[45] Date of Patent: Jun. 24, 1986

[54] HAIR DRESSING COMB

[75] Inventors: Frank J. Renda, 752 Colonial Ave., York, Pa. 17403; George C. Mitch, York, Pa.

[73] Assignee: Frank J. Renda, York, Pa.

[21] Appl. No.: 613,425

[22] Filed: May 24, 1984

[51] Int. Cl.[4] ..... A45D 24/10

[52] U.S. Cl. ..... 132/123; 132/11 R

[58] Field of Search ..... 132/9, 123, 11 R, 122, 132/126, 129, 121, 31 R, 33 R

[56] References Cited

U.S. PATENT DOCUMENTS

| | | | |
|---|---|---|---|
| 2,137,828 | 11/1938 | Arpin et al. | 132/123 |
| 2,225,454 | 12/1940 | Kayn | 132/123 |
| 2,244,068 | 6/1941 | Kay | 132/123 |
| 2,245,056 | 6/1941 | Schlicker | 132/123 |
| 2,803,256 | 8/1957 | Lerner | 132/123 |
| 3,150,393 | 9/1964 | Taylor et al. | 15/23 |
| 4,191,200 | 3/1980 | Renda | 132/123 |
| 4,327,753 | 5/1982 | Bertschi | 132/123 |
| 4,335,732 | 6/1982 | Megna | 132/123 |

FOREIGN PATENT DOCUMENTS

| | | | |
|---|---|---|---|
| 1503335 | 2/1967 | France | 132/123 |

*Primary Examiner*—Robert P. Swiatek
*Assistant Examiner*—David L. Tarnoff
*Attorney, Agent, or Firm*—C. Hercus Just

[57] ABSTRACT

A hair dressing comb assembly comprising a generally cylindrical housing from one end of which a handle extends, and a plurality of similar longitudinally extending slots are arranged in circumferentially spaced relation around the housing respectively to receive elongated toothed comb members having relatively thin ends projecting beyond the toothed portions, the housing containing in opposite ends similar cam members interconnected longitudinally and movable axially by a manually operable sleeve on the exterior of the handle for movement in one direction to cause the cams to engage the thin ends of the comb members to project the combs outwardly to full operative positions, and separate retracting springs engageable with the thin ends of the comb members to fully retract them simultaneously into the slots in the housing when the sleeve on the handle moves the cam members in the opposite direction.

26 Claims, 15 Drawing Figures

Fig. 7
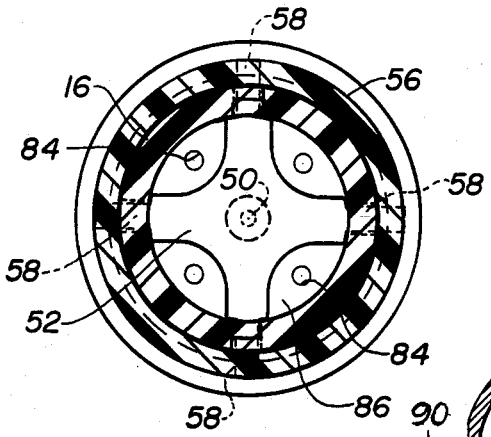
Fig. 8
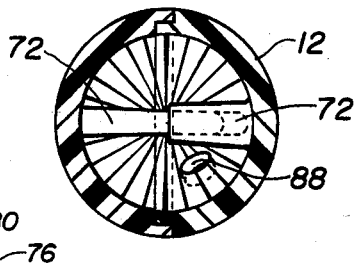
Fig. 15
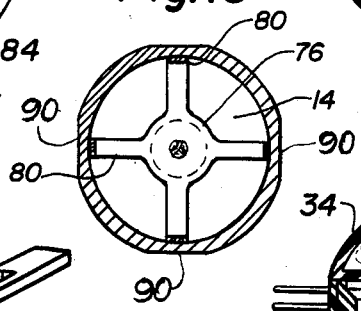
Fig. 9
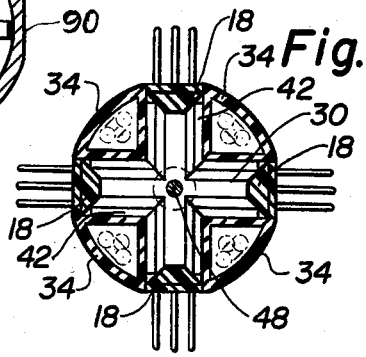
Fig. 10
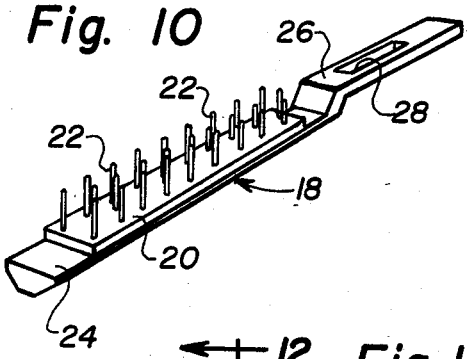
Fig. 11
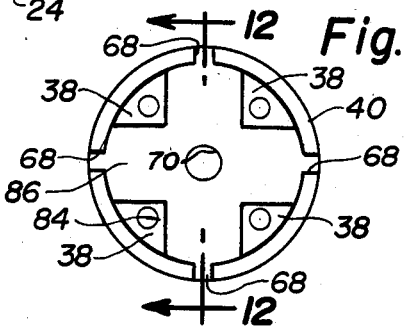
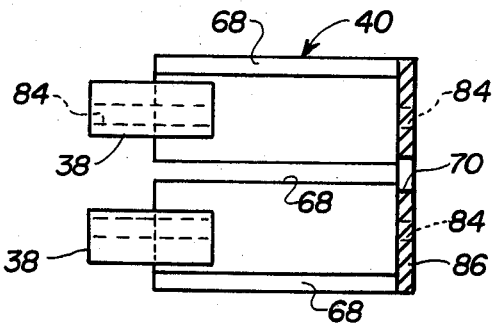
Fig. 12
Fig. 13
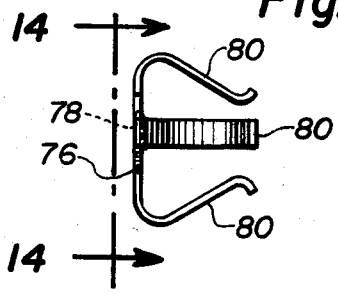
Fig. 14
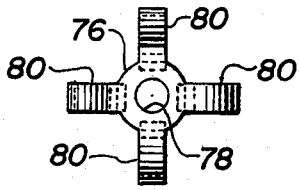

HAIR DRESSING COMB

BACKGROUND OF THE INVENTION

The present invention essentially is an improvement over a prior invention of one of the instant applicants which is covered by prior U.S. Pat. No. 4,191,200, dated Mar. 4, 1980, to Frank J. Renda. Basically, the present invention, as well as that of said prior patent, is directed to a hair dressing comb having a plurality of suitable comb members which are retractable into and projectable from circumferentially spaced, suitable openings in a generally tubular housing member having a handle on one end. One of the objectives of said prior patent was to devise a comb assembly having a housing in which longitudinal openings accommodated a plurality of suitable, relatively narrow comb members which were projectable by means of cams engageable slidably with angular surfaces adjacent opposite ends of the comb members per se but it was found that, while the mechanism included in said arrangement operated to a high degree of satisfaction for projecting the comb members from the slots and retracting them thereinto, the resulting structure had a greater diameter than was found desirable for operation by hair dressers and tonsorial artists relative to wrapping strands of hair around the comb and then retracting the comb members into the housing to permit ready removal of the comb assembly from a wrapped curl. In an effort to devise a comb of satisfactory smaller diameter, it was found necessary to include a substantial number of changes and improvement in devising the present invention over the structure of the comb comprising the subject matter of said prior patent.

Although there are a number of prior patents pertaining to projectable and retractable comb members and similiar brush members with respect to slots in a housing, a number of which are referred to in said prior U.S. Pat. No. 4,191,200, including those cited during the examination of said patent, as well as prior U.S. Pat. Nos. 2,225,454 to Kayn, dated Dec. 17, 1940; 3,150,353 to Taylor et al, dated Sept. 29, 1964; and French Pat. No. 1,503,353, to Rayette-Faberge, Inc., dated 1967, none of these disclose or suggest the solutions which have been arrived at in devising the present invention primarily for purposes of producing a generally cylindrical housing of relatively small diameter extending from one end of a handle and provided with longitudinally extending slots disposed in evenly spaced circumferential relationship and containing similar elongated comb members in said slots respectively for complete retraction thereinto and radial projection therefrom to operative position, details of which are set forth below.

SUMMARY OF THE INVENTION

It is the principal object of the present invention to provide a hair dressing comb having a relatively small diameter housing provided with a plurality of longitudinally extending slots in circumferentially spaced relationship respectively containing similar elongated comb members having teeth of suitable length projecting from one surface of a relatively thin base member from which similarly thin extensions project from opposite ends respectively engageable by cam means movably supported within opposite ends of the housing of the comb assembly which extends longitudinally from one end of an appropriate handle and upon which an actuating member is manually operable to effect projection and retraction of the comb members within the slots in the housing thereof, the thinness of extensions on the opposite ends of said comb members being directly engaged by the cam means making it possible to provide effective projection and retraction of the comb members while having the overall diameter of the housing which contains the comb members relatively small and highly acceptable to hair dressing barbers and operators as well as tonsorial artists.

It is another object of the invention to provide a housing which at one end has a cap and the opposite end is connected to one end of the handle, and a plurality of similar elongated quadrant members extend therebetween in circumferentially spaced relationship to provide slots complementary to the width of the comb members and adapted to slidably receive the same for movement between fully retracted and fully projected positions of the teeth on the elongated comb members.

A further object of the invention is to provide the cam members respectively at opposite ends of the housing in the form of radial segments having angular camming surfaces thereon directly adjacent dwell surfaces which extend from the outer ends of said angular cam surfaces in parallel relation to each other and to the axis of the housing, said dwell surfaces engaging the inner surfaces of the extensions on opposite ends of the comb members when the latter are in fully projected, operative position and thereby latching the same in said position until the cam members are moved in a direction to dispose the angular cam surfaces in engagement with said extensions on the comb members, followed by said extensions riding downward along the cam surfaces to fully retracted position and in which the inner surfaces of the relatively thin base members of the elongated comb members are disposed adjacent a central elongated rod which extends between and is connected to the longitudinally spaced cam members and also is connected at one end to the aforementioned manual engageable means on the handle by which the movement of the cam members is effected in opposite direction respectively to effect retracting and projecting movements of the comb members.

Still another object of the invention is to employ improved spring means especially for purposes of retracting the comb members from projected, operative position to fully retracted position within the openings in the housing, said spring members preferably being generally U-shaped and pairs of said U-shaped spring members being transverse to each other and integral in cruciform arrangement, whereby all of the legs of said members extend in a common direction from the base of said U-shaped members and initially, in repose, are angularly directed toward each other at the outer end which is the position they assume when holding the extensions on the opposite ends of the comb members in fully retracted position.

Still another object of the invention contributing to the objective of a relatively small diameter housing comprising disposing the extensions on one end of each comb member in radial offset relationship to the comb members a predetermined distance in order to allow for an adequate hub for the cam within the end of the handle to which the housing is connected and of larger diameter than the cap at the outer end of the housing for purposes of providing guide means for the cam member adjacent the handle and in relation to which the U-shaped spring members are spaced apart a slightly greater distance than the fingers of the cam members at the outer end of the housing.

Details of the foregoing objects and of the invention, as well as other objects thereof, are set forth in the following specification and illustrated in the accompanying drawings comprising a part thereof.

DETAILED DESCRIPTION OF THE DRAWINGS

Figures 1, 2, 3, 4, 5, 6:
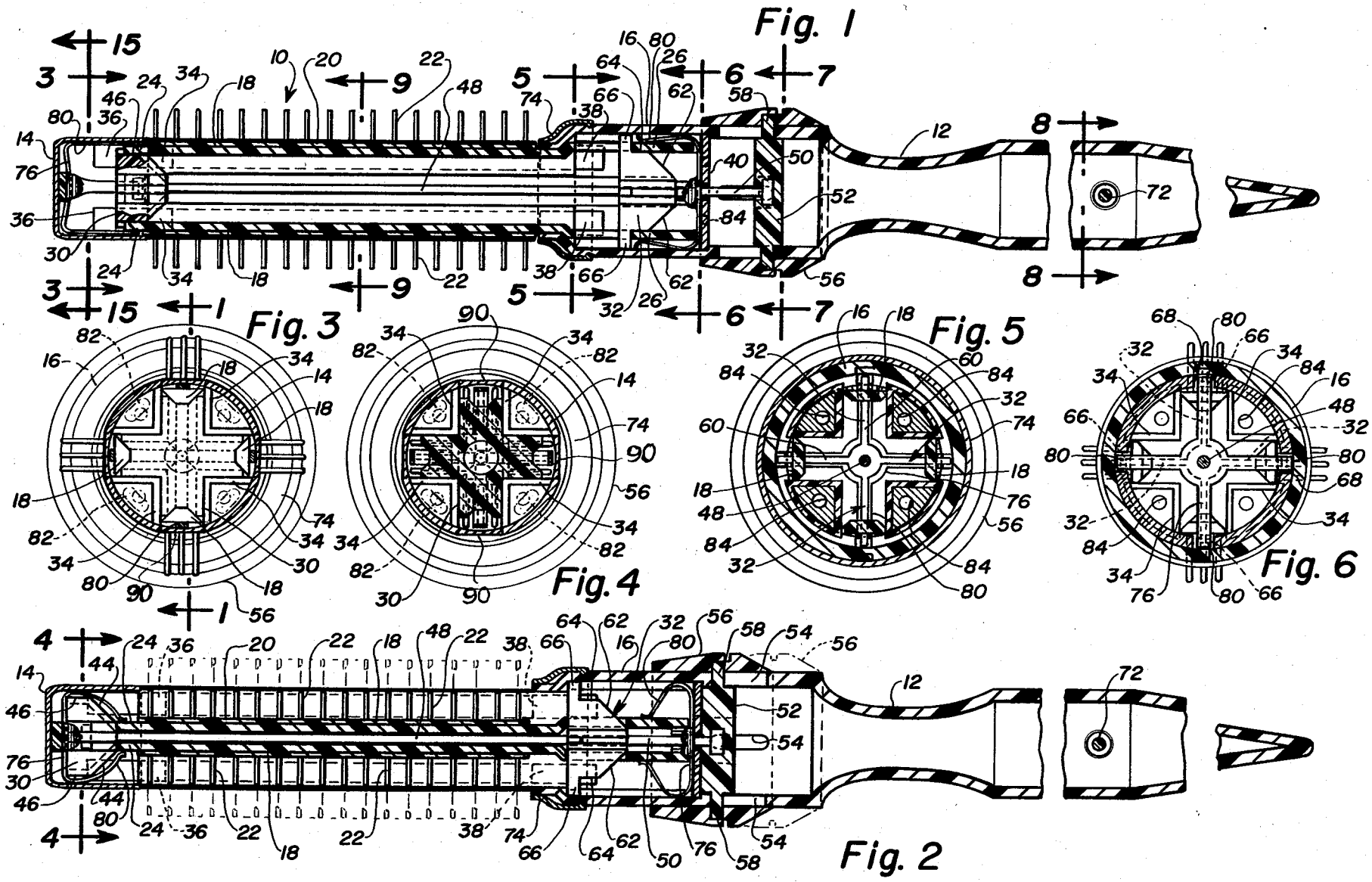
FIG. 1 is a generally longitudinal section of a hair dressing comb embodying the principles of the present invention and illustrating the comb members thereof in projected position, said view being taken on the line 1—1 of FIG. 3.
FIG. 2 is a longitudinal sectional view similar to FIG. 1, but showing the comb members in a retracted position within the housing.

FIG. 3. is a sectional view taken on the line 3—3 of FIG. 1.

FIG. 4 is a sectional view taken on the line 4—4 of FIG. 2.

FIG. 5 is a sectional view taken on the line 5—5 of FIG. 1.

FIG. 6 is a sectional view taken on the line 6—6 of FIG. 1.

FIG. 7 is a sectional view taken on the line 7—7 of FIG. 1.

FIG. 8 is a sectional view taken on the line 8—8 of FIG. 1.

FIG. 9 is a sectional view taken on the line 9—9 of FIG. 1.

FIG. 10 is a perspective view of one of the elongated comb members of the comb assembly shown in the preceding figures.

FIG. 11 is a detailed end view of the thimble-like guide member mounted in one end of the handle of the comb assembly shown in FIGS. 1 and 2 as viewed from the open end of said thimble-like guide member.

FIG. 12 is a transverse sectional view of the thimble-like guide member shown in FIG. 11 as seen on the line 12—12 thereof.

FIG. 13 is a side elevation of one of the contracting spring members engageable with one end of the elongated comb members illustrated in certain of the preceding figures.

FIG. 14 is an end view of the spring member shown in FIG. 13 as viewed on the line 14—14 thereof.

FIG. 15 is a sectional view taken on the line 15—15 of FIG. 1.

DETAILED DESCRIPTION OF THE PREFERRED EMBODIMENTS OF THE INVENTION

As mentioned hereinabove, one of the principal objectives of the present invention is to provide a hair dressing comb having a plurality of elongated toothed comb members which are readily projectable from and retractable into a housing member of suitable diameter to render the comb highly suitable for use by barbers, beauticians, and tonsorial artists for curling hair around the comb while the toothed comb members are projected and then, at the completion of the formation of the curl, quickly retracting all of the teeth of the comb member simultaneously so as to permit ready withdrawal of the comb from the completed curl. To accomplish this, it is essential that the diameter of the portion of the comb around which the hair is curled must be of a reasonable diameter such, for example, as approximately 0.875 inches, or about 21 millimeters, which diameter has been found to be highly efficient and practical but it is to be understood that the same is solely exemplary and not restrictive. It is this feature of the present invention that primarily distinguishes it over the structure illustrated and claimed in prior Pat. No. 4,191,200 of one of the co-inventors of the present invention.

In said aforementioned prior patent, the actuation of the comb members is achieved by having cam-shaped notches formed directly in blade-like base portions of the individual comb members from which the teeth projected. The substantially cone-shaped cam members directly engage said cam-shaped notches to effect projection thereof and the cam members repose in said notches when the comb members are retracted. Such a structure necessarily results in a diameter of the comb product which is greater than is desired by many users and thus means were sought by the patentee and his collaborating co-inventor of the present invention to produce a hair dressing comb of a practical diameter without sacrificing durability and effectiveness and the present invention is the result of such additional inventive effort, the details of which are as follows Referring to FIGS. 1 and 2, it will be seen that the hair dressing comb assembly shown therein comprises a cylindrical housing 10 which is connected to one end of a handle 12. The housing 10 comprises the comb portion of the assembly and attached to the outer end of the housing 10 is a cap 14 which is fixed to said housing and the handle 12 has a forward portion 16 which also comprises part of the housing 10 and contains mechanisms similar to that contained in the cap 14 as described in detail hereinafter.

A plurality of elongated comb members 18 are contained within the housing 10 and one such comb member is shown in perspective in FIG. 10. It will be seen that said comb members comprise a relatively thin, elongated body member 20 from which a plurality of integral comb teeth 22 extend from one surface. The opposite ends of the comb members 18 also have a relatively thin forward extension 24 and a rearward, laterally offset thin axial extension 26 which contains an elongated slot 28 for purposes to be described.

Referring to FIG. 1, it will be seen that the forward extensions 24 of the comb members 18 extend into the side walls of the cap 14 and the rearward offset extensions 26 extend axially into the forward portion 16 of handle 12. A forward cam 30 also is disposed within cap 14 and a rearward cam 32 is disposed within the forward portion 16 of handle 12 and is considered to be part of the housing as indicated above.

Referring to FIG. 9 which is taken on the line 9—9 of FIG. 1, it will be seen that the cylindrical housing 10 basically and specifically comprises a plurality of elongated segmental quadrant members 34, at least the ends of which are hollow for purposes of receiving respectively in the opposite ends thereof, positioning lugs 36 preferably are integrally formed on the interior of cap 14, see FIG. 1, and additional positioning lugs 38 integrally connected to and projecting from a cup-shaped guide member 40, see FIG. 12, which is fixedly mounted within the forward portion 16 of handle 12 as shown in FIG. 1. The segmental quadrant members 34 may be molded from plastic material as indicated by the cross hatching of FIG. 9, or the same may be metal extrusions, as desired. Other materials also may be used. In any event, the exterior shape of the members 34 is important, especially since the inner walls thereof are so arranged that corresponding walls of adjacent quadrant members provide elongated openings or slots 42 within which the comb members 18 freely move between fully projected, operative positions as shown in FIG. 1, and fully retracted positions as shown in FIG. 2.

One of the features of the present invention which has largely led to the capability of producing a hair dressing comb of suitable practical diameter comprises the arrangement and shape of the forward cam 30 and rearward cam 32. Especially from FIGS. 3, 4 and 9, it will be seen that the forward cam 30 is cross-shaped and, as seen from FIG. 1, has angular cam surfaces 44 which, at the outermost radial portions thereof, merge with horizontal dwell surfaces 46 as is best seen from FIG. 2. Assuming that the comb members 18 are in the retracted position as shown in FIG. 2 and cam 30 is moved rearwardly by means to be described, the cam surfaces 44 initially engage beneath the thin projections 24 and will cam the forward ends of the comb members radially outward until the fully projected position thereof is reached as shown in FIG. 1, at which time the dwell surfaces 46 will be disposed beneath the projections 24 and latch the forward ends of the combs in the projected position. It will be seen that the forward cam 30 and the rearward cam 32 are interconnected by an elongated rod 48 which is shown in FIGS. 1 and 2 as well as in FIGS. 5 and 6. The rod also has an extension 50 at the inner end thereof which is fixed to a spider 52 disposed within the forward portion 16 of handle 12 as best shown in FIGS. 1 and 2. The portion 16 has slots 54 through which pins on the spider 52 extend for connection to an exterior manually engageable slidable sleeve 56 which, incidentally, may be formed of two sections which are interfitted and shaped to include the pins 58 therebetween in order that the sleeve may be manually manipulated simultaneously to move forward and rearward cams 30 and 32 forwardly or rearwardly as desired to either project or retract the comb members 18.

Rearward cam 32, as well as forward cam 30, actually is a cluster of similar cam members. The individual cam members of the forward cam 30 are thicker than the individual cam members 60 of rearward cam 32, the latter being best illustrated in FIG. 5. Further, as shown in FIGS. 1 and 2, the individual cam members 60 of rearward cam 32 have angular cam surfaces 62 which, at the outermost radial end thereof merge with horizontal and parallel dwell surfaces 64 which, at the outer ends thereof terminate in radially projecting guide lugs 66 which operate in slots 68 formed in the cylindrical walls of the cup-chaped guide member 40 as shown in FIGS. 11 and 12. Incidentally, the extension 50 of connecting rod 48 extends through a hole 70 in the end wall of the guide member 40 as clearly shown in FIGS. 11 and 12. From FIGS. 1 and 2, it also will be seen that the rearward cam 32 has a greater transverse dimension than the forward cam 30, due primarily to the laterally offset extensions 26 on the rearward ends of the comb members 18. Said offset arrangement was found to be necessary to contribute to the relatively small diameter of the cylindrical housing 10. The handle 12 preferably is manufactured in two similar parts extending longitudinally which are mirror images of each other and appropriate connecting means 72 are provided in the form of companion posts through which either pins or screws may extend and it will be understood that the two sections abut each other to form a smooth handle which is circular in cross-section but of variable diameters as shown in FIGS. 1 and 2. The forward portions of the sections also may be joined conveniently by any suitable means such as a circular, snap-type ferrule 74 which preferably may be formed from suitable metal or otherwise.

The means by which the comb members 18 are projected having been described above, the mechanism by which the comb members are retracted is now described as follows. Especially for compactness and feasibility, substantially U-shaped springs 76 are employed. These are somewhat spider-shaped as shown in FIG. 14 in end view, while the side view of the same is shown in FIG. 13. Preferably, a pair of the U-shaped springs are employed and these are arranged in cruciform as shown in FIG. 14. A central hole 78 is provided for purposes of attaching a spring 76 to the interior of cap 14. Opposite legs 80 of each of the pairs of U-shaped springs actually slope toward each other at the outer ends as best shown in FIG. 13 and the terminal ends of the legs also may be rounded as shown in said Figure to facilitate the engagement of said terminal ends respectively with the outer surfaces of the forward extensions 24 of the comb members 18 as best shown in FIG. 2 wherein the comb members 18 are in retracted position. Due to the space within the cup-shaped guide member 40 in which the rearward U-shaped springs 76 are located, said spring members are larger than the spring members which engage the forward end portions of the comb members as can be readily visualized especially from FIG. 2 in which the combs are retracted. When the comb members 18 are projected to the positions shown in FIG. 1, the legs 80 thereof are expanded and assume substantially parallel positions as shown best in FIG. 1. From this however, it will be seen that the springs constantly maintain the projections 24 and 26 of the comb members 18 either in engagement with the angular cam surfaces 62 of the forward and rearward cam members for even, parallel projection of the comb members outwardly with respect to each other or, when the limit of outward movement has been reached, the dwell surfaces 46 of the forward cams and 64 of the rearward cams are maintained firmly in abutment with the thin extensions 24 and 26 of the comb members due to the strength of the flexible legs 80 of the spring members 78. It also will be understood that the strength of the legs in each of the spring members is similar for even actuation of the comb members and especially the movement thereof in retracting directions.

When the comb members 18 are in retracted positions as shown in FIG. 2 the tip ends of the teeth 22 preferably will be slightly below the upper edges of slots 42, which are formed between quadrant members 34 as can be seen in FIG. 4, or at most, they will be no more than flush with the outer ends of said slots. In such position, the outer surfaces of cap 14 which are adjacent said slots, if cylindrical, conceivably could comprise projections which could catch on hairs of a completed curl and thereby mar or disfigure the curl. To prevent such occurrence, it will be seen from FIGS. 4 and 15 especially that flat relief surfaces 90 are formed at four locations on the exterior of the cap 14 in axial alignment with the slots 42 and hence no obstructing projection is present which might otherwise snag a curl while the comb is being removed therefrom. Otherwise, the exterior surfaces of cap 14 are flush with the ends of the segmental quadrant members 34 and thereby provide smooth continuous longitudinal surfaces.

Also as shown in FIG. 2, when the comb members 18 are in fully retracted positions, the innermost portions of the thin body members 20 of comb members 18 are approximately in contact with the rod 48 which connects the forward and rearward cams 30 and 32. Such close positioning of the thin body members of the comb members is made possible by the somewhat triangular cross-sectional shape of the thin body members 20, as also shown by dotted lines in cross-sectional FIG. 4, wherein the teeth of the comb members are shown in fully retracted position and the apexes of said triangular shaped body members extend substantially into engagement with rod 48 which connects said cams 30 and 32.

In certain hair dressing operations, it is preferred that heat accompany the curling of hair by means of a comb or otherwise. To render the present invention capable of affording the use of heat, and particularly where the segmental quadrant members 34 are hollow, they are well adapted to contain appropriate, preferably electrically energized heating elements 82 shown, for example, in FIGS. 3 and 4 in phantom. Electrical wires, not shown, appropriately may extend through holes 84 formed in the end wall 86 of guide member 40 and, for example, one of the halves of the handle 12 may have another hole 88 formed therein, as shown in FIG. 8, and from there the outer end of the wire may be connected to a suitable source of electric current.

From the foregoing, it will be seen that the present invention provides a hair dressing comb having readily retractable and projectable elongated comb members which are actuated in both projecting and retracting directions by relatively simple, compact devices which contribute to the diameter of the comb portion in particular being of relatively small, practical dimension and to accomplish this, certain types of camming elements are employed to project the combs in parallel relationship to each other, and similar spring mechanisms are employed respectively to engage opposite ends of the comb members to accurately keep them in engagement with either the angular cam members to project the combs or retain the projecting ends of the comb members on dwell surfaces on the cam members to latch the same in projected, operative position of the comb members. Effecting such projection of the comb members is accomplished by easy and simple movement of a sleeve-type actuating member slidably freely upon the forward portion of a handle which extends from one end of the cylindrical housing in which the individual comb members are mounted and, when the dwell portions of the cam members are in engagement with the relatively thin opposite ends of the comb members, they will be retained in that position without any locking movement of the manually operated sleeve being required, for example. As soon as the sleeve member is moved forwardly, the spring means respectively at opposite ends of the comb members quickly and instantly retract the comb members by causing the ends thereof to slide down the angular cam surfaces of the cam member. Heating means, if desired, also are readily included in the hair dressing comb comprising the present invention.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

What we claim is:

1. A hair dressing comb assembly generally comprising in combination a substantially cylindrical housing, a handle extending axially from one end thereof, a plurality of elongated toothed combs extending longitudinally within said housing in circumferentially spaced relationship to each other, said housing having longitudinally extending openings through which at least the teeth of said combs are projectable radially outward to operative positions from fully retracted positions within said housing, cam means mounted respectively within and adjacent opposite ends of said housing, means extending longitudinally within said housing and interconnecting said cams for simultaneous longitudinal movement thereof for engagement respectively with opposite end portions of said combs and operable to project all of said combs evenly outward simultaneously when said cams are moved in one longitudinal direction, and separate means adjacent opposite ends of said housing respectively supporting therein separate retracting spring means and each of said spring means having circumferentially spaced portions engageable with end portions of each of said combs and operable to retract said combs fully into said housing when said cams are moved in the opposite direction.

2. The comb assembly according to claim 1 further characterized by at least said end portions of said combs which are engaged by said cam means being relatively thin and extending longitudinally beyond the toothed areas of said combs, whereby when said combs are in fully retracted positions, the innermost portions of said combs are positioned close to the central axis of said housing and thereby permit the diameter of said housing to be minimal.

3. The comb assembly according to claim 1 further characterized by said combs each comprising a relatively thin base strip from which integral teeth project from one surface and said strips having end portions which are free of teeth and are slidably engageable by said cam means to project the teeth of said combs from said housing when said cam means are moved in one direction as aforesaid.

4. The comb assembly according to claim 1 further including an annular manually engageable member slidably surrounding said handle and interconnected to one end of said means which interconnect said cams and operable to move said cams as aforesaid.

5. The comb assembly according to claim 1 further characterized by said cam means each having an angled cam surface adjoining a latching dwell surface substantially parallel to the axis of said housing and engageable with the end portions of said combs and operable to latch said combs releasably in projected positions when said dwell surfaces are engaged with said end portions of said combs.

6. The comb assembly according to claim 1 further characterized by said means interconnecting said cams comprising a rod fixed to and extending between said cams and one end of said rod projecting beyond the cams and into said handle, and said handle further including a manually engageable member surrounding a portion of said handle and slidable thereon and connected to said one end of said rod to effect movement of said cams by said slidable member.

7. The comb assembly according to claim 1 further characterized by said elongated combs being in excess of three and said cams comprising clusters of similar cam members corresponding in number to said combs and evenly circumferentially spaced from each other in accordance with said elongated combs, said cam members each being no wider than said elongated combs and slidably engaging surfaces of axial extensions on said elongated combs which are nearest the axis of said housing.

8. The comb assembly according to claim 7 further including an end cap enclosing the spring means and cam means adjacent the outer ends of said toothed combs, means fixed to said handle adjacent the inner ends of said toothed combs comprising a portion of said housing which encloses the spring means and cam means adjacent the inner ends of said combs, the teeth on said combs extending between said end cap and said portion of said housing, extensions on the opposite ends of said combs extending into said cap and portion of said housing for engagement by said cam means, and means within said cap and portion of said housing respectively securing said spring means against axial movement.

9. The comb assembly according to claim 7 in which the outer end of said housing comprises a cap and said spring means comprise spider-like configurations of resilient fingers anchored respectively within said cap adjacent one end of said elongated combs and a portion of said housing adjacent the opposite ends of said elongated combs, the outer ends of said resilient fingers extending toward the axis of said comb assembly and respectively engage end portions projecting from opposite ends of said elongated combs and operable to retract said elongated combs into said housing when said cam means are moved in the opposite direction from that which projects said elongated combs to operative positions.

10. The comb assembly according to claim 9 further characterized by said longitudinally extending openings through which said elongated combs extend comprising slots of uniform width extending between said cap and an opposite portion of said housing nearest said combs, the sides of said slots being defined by elongated segmental members extending between and the ends thereof respectively being anchored to said cap and said opposite portion of said housing, and said elongated combs having opposite end portions projecting axially beyond the toothed areas respectively into said cap and said opposite portion of said housing and operable to limit the projecting movement of said elongated combs and also being engageable by said cam means to project said comb members.

11. The comb assembly according to claim 10 in which at least the ends of said elongated segmental members are hollow and said cap and said opposite portion of said housing having complementary projections extending into the hollow ends of said elongated members.

12. A hair dressing comb assembly comprising in combination, an axially elongated handle, an end cap longitudinally spaced from one end of said handle, circumferentially spaced elongated quadrant members extending longitudinally between and fixed at the ends thereof respectively to said cap and said one end of said handle, said quadrant members being transversely spaced equal distances to define parallel slots, elongated comb members respectively movable radially within said slots between fully retracted inner positions therein and projected positions in which teeth on said comb members project beyond the outer edges of said slots, the opposite ends of said comb members having relatively thin axial extensions respectively projecting limited distances into said cap and said one end of said handle and engageable with surfaces thereof when said comb members are projected outward to limit said projecting movements of said members and establish the operative positions of said comb members, cam members respectively disposed within said cap and one end of said handle and having angular camming surfaces on radial segments respectively engageable with surfaces of said thin extensions on the opposite ends of said comb members, a rod extending longitudinally between said cam members to connect them for simultaneous axial movement in one direction to project said comb members to operative positions, manually engageable means movable relative to said handle and connected to said rod to actuate it, and retracting spring means engaging the outermost surfaces of said thin extensions on said opposite ends of each of said comb members and operable to cause surfaces on said extensions on said opposite ends of said comb members equally to slide along the angular cam surfaces of said radial segments when said cam members are moved axially in comb retracting direction.

13. The comb assembly according to claim 12 in which said manually engageable means movable on said handle comprises a sleeve slidable a limited distance along said handle adjacent said one end of said handle, transverse means within said one end of said handle connected to one end of said rod, and means on said transverse means also extending through slot means in said one end of said handle and connected to said sleeve.

14. The comb assembly according to claim 13 in which said transverse means comprises a spider member having ends extending through said slot means and connected fixedly to said sleeve.

15. The comb assembly according to claim 12 in which said retracting spring means are substantially U-shaped and the legs thereof respectively engage the thin extensions of an opposite pair of said comb members and are operable to maintain said extensions in slidable engagement with said angular camming surfaces and thereby insure parallelism of said comb members at all times.

16. The comb assembly according to claim 15 further characterized by said radial segments of said cam members each having a dwell surface substantially parallel with said rod and each other and connected to and extending away from the radially outermost end of each angular camming surface of said cam members, said dwell surfaces being disposed beneath said thin extensions on said comb members when said comb members are fully projected to operative position, and said U-shaped springs also being operable to maintain said thin extensions in firm contact with said dwell surfaces when said comb members are so projected to latch said comb members in projected operative positions.

17. The comb assembly according to claim 16 in which said spring means at opposite ends of said comb members respectively comprising a pair of substantially U-shaped spring members arranged in cruciform disposal, the legs of said spring members being substantially of equal length and strength and respectively engaging the outermost surfaces of said thin extensions on said comb members.

18. The comb assembly according to claim 17 in which the thin extensions on the ends of the comb members nearest said one end of said handle being longitudinally slotted and longer than the extensions on the outer ends of said comb members and also being laterally offset away from said rod a predetermined greater distance than the thin extensions on the opposite ends of said comb are spaced from said rod, said one end of said handle containing a cup-shaped guide member having circumferentially spaced and axially extending slots corresponding in number to the radial segments of the cam member at said adjacent end of said comb members, and the dwell surfaces on said radial segments at said end of said comb members also having short radial projections slidably disposed within said slots in said guide member and also extending through the slots in said offset extensions of said comb members to provide guide means for said ends of said comb and cam members.

19. The comb assembly according to claim 17 in which a cup-shaped guide member is mounted adjacent said one end of said handle and has a limited greater diameter than the end cap on the outer end of said comb assembly opposite said handle, and the legs of the U-shaped spring means which engage the extensions on the ends of the comb members adjacent said handle being movable within said cup-shaped guide member and spaced farther apart radially than the legs of the springs in the opposite end of the comb assembly to accommodate said springs within said cup-shaped guide member.

20. The comb assembly according to claim 12 further including electrical resistance heating means mounted within the interior of at least certain of said quadrant members.

21. A hair dressing comb assembly generally comprising in combination a substantially cylindrical housing, a handle extending axially from one end thereof, a plurality of elongated toothed combs extending longitudinally with said housing in circumferentially spaced relationship to each other, said housing having longitudinally extending slots of predetermined width through which at least the teeth of said combs are projected radially outward to operative positions from fully retracted positions within said slots, the outer end of said housing comprising a cap, cam means mounted respectively within and adjacent opposite ends of said housing, means extending longitudinally within said housing and interconnecting said cams for simultaneous longitudinal movement thereof for engagement respectively with opposite end portions of said combs and operable to project all of said combs evenly outward simultaneously when same cams are moved in one longitudinal direction, separate retracting spring means respectively mounted in said cap and the opposite end of said housing and having circumferentially spaced portions engageable with end portions of each of said combs and operable to retract said combs fully into said slots in said housing when said cams are moved in the opposite direction, and the exterior surface of said cap being substantially flush with the exterior surface of said housing and said cap having circumferentially spaced flat relief surfaces thereon respectively in longitudinal alignment with the outer ends of said slots, whereby when said combs are in retracted position the exterior surface of said cap is free of any projections or obstructions during removal of the comb from a completed curl.

22. A hair dressing comb assembly comprising in combination, a plurality of elongated similar segmental members having arcuate outer surfaces spaced circumferentially around a central axis of said comb to form a generally cylindrical housing, means at the opposite ends of said members engaging the same and securing them in fixed positions relative to each other, a handle extending axially outward from one of said means, said members having sides spaced equally from each other to form elongated slots of uniform width, a plurality of elongated comb members each having a relatively thin base strip from one surface of which integral comb teeth of substantially uniform length extend, said strips having a width similar to that of said slots and positioned therein for radial sliding movement between a fully retracted position wherein the outer ends of said teeth do not extend above the outer ends of said slots and a fully projected position in which substantially the full length teeth of said comb members project beyond the outer ends of said slots, cam means commonly and respectively engaging the opposite end portions of said base strips of said comb members to project the comb members evenly and uniformly from said slots when moved longitudinally in one direction within said housing, and a single retracting means mounted in opposite ends of said housing operated from means adjacent said handle and engageable respectively with opposite ends of each of said comb members to move them uniformly and substantially completely into said slots when said cams are moved longitudinally in the opposite direction.

23. The hair dressing comb according to claim 22 in which said cams are connected by an axial rod and when said comb members are in said fully retracted positions within said housing, the innermost portions of the base strips of said comb members are closely adjacent said rod, whereby the diameter of said cylindrical housing may be relatively small and not substantially in excess of 0.875 inches.

24. The hair dressing comb according to claim 22 in which said thin body members of said comb members are substantially triangular in cross-section and the apexes of said comb members extend substantially to said rod when said comb members are in the fully retracted position and thereby minimize the diameter of said housing.

25. The hair dressing comb according to claim 22 in which said segmental members are quadrant shape in cross-section and each have two similar elongated planar members connected along one edge substantially at a right angle and the opposite edges of said surfaces being connected respectively to the edges of another member which is arcuate in cross-section, whereby at least the ends of said segmental members are hollow and receive positioning and supporting lugs mounted in said housing adjacent the opposite ends of said comb members.

26. The hair dressing comb according to claim 25 in which said elongated planar members of adjacent segmental members, when said members are connected to form said housing, are spaced apart even distances and are parallel to form said slots for said comb members.

* * * * *